US007195524B1

(12) United States Patent
Lin

(10) Patent No.: US 7,195,524 B1
(45) Date of Patent: Mar. 27, 2007

(54) ELECTRICAL TERMINAL ASSEMBLY HAVING A DETACHABLE COUPLING HEAD DETACHABLE FROM A TERMINAL BY INSERTING A TOOL INTO THE COUPLING HEAD

(75) Inventor: Tien-Hsing Lin, Tainan Hsien (TW)

(73) Assignee: Hantechnic Incorporated, Tainan Hsien (TW)

( * ) Notice: Subject to any disclaimer, the term of this patent is extended or adjusted under 35 U.S.C. 154(b) by 0 days.

(21) Appl. No.: 11/527,945

(22) Filed: Sep. 26, 2006

(51) Int. Cl.
*H01R 11/22* (2006.01)

(52) U.S. Cl. ..... 439/851; 385/53

(58) Field of Classification Search ..... 439/851, 439/350, 578, 842, 852; 85/53, 75
See application file for complete search history.

(56) References Cited

U.S. PATENT DOCUMENTS 2,626,299 A * 1/1953 Richards ..... 439/314
3,954,319 A * 5/1976 Haines ..... 439/294
4,526,431 A * 7/1985 Kasukawa ..... 439/153
5,217,391 A * 6/1993 Fisher, Jr. ..... 439/578
5,603,631 A * 2/1997 Kawahara et al. ..... 439/352
6,550,977 B2 * 4/2003 Hizuka ..... 385/55
2005/0265666 A1 * 12/2005 Johnson ..... 385/53
2006/0263011 A1 * 11/2006 Chen et al. ..... 385/75

FOREIGN PATENT DOCUMENTS

JP EP 0616387 * 3/1994

* cited by examiner

*Primary Examiner*—Michael C. Zarroli
(74) *Attorney, Agent, or Firm*—Ladas & Parry LLP

(57) ABSTRACT

A coupling head includes resilient engaging arms arranged circumferentially in a sleeve body. Each engaging arm is connected integrally to an annular inner surface of the sleeve body, has a free end extending toward a first open end of the sleeve body and spaced apart from the inner surface of the sleeve body, and is formed with a protrusion. A tubular electrical terminal extends into the sleeve body via a second open end of the same, and has an annular outer surface formed with an annular engaging groove that engages detachably the protrusions of the engaging arms, thereby confining the electrical terminal in the sleeve body. The protrusions of the engaging arms are disengaged from the engaging groove in the electrical terminal by moving the free ends of the engaging arms toward the inner surface of the sleeve body using a tool.

7 Claims, 8 Drawing Sheets

ELECTRICAL TERMINAL ASSEMBLY HAVING A DETACHABLE COUPLING HEAD DETACHABLE FROM A TERMINAL BY INSERTING A TOOL INTO THE COUPLING HEAD

BACKGROUND OF THE INVENTION

1. Field of the Invention

The invention relates to a detachable coupling head for use with an electrical terminal detachable from the coupling head by inserting a tool into the coupling head.

2. Description of the Related Art

FIGS. 1 and 2 illustrate a conventional electrical terminal assembly that is configured to electrically couple transmission wires 10, 10' and that includes a male coupling head 11, a tubular first electrical terminal 12, a female coupling head 21, a tubular second electrical terminal 22, and a positioning member 13. Each of the male and female coupling heads 11, 21 is configured as a sleeve that permits insertion of a respective one of the first and second electrical terminals 12, 22, and is formed with a resilient engaging arm 111, 211. The first electrical terminal 12 has a coupling end connected electrically to the transmission wire 10, and is inserted into the male coupling head 11. The first electrical terminal 12 has an annular outer surface formed with an annular engaging groove 121 and an annular positioning groove 122. The positioning member 13 is mounted on the male coupling head 11, and has opposite resilient positioning arms 131. When the first electrical terminal 12 is inserted into the male coupling head 11, the engaging arm 111 of the male coupling head 11 and the positioning arms 131 engage respectively the annular engaging groove 121 and the annular positioning groove 122 in the first electrical terminal 12, thereby positioning the first electrical terminal 12 in the male coupling head 11. The second electrical terminal 22 has a coupling end connected electrically to the transmission wire 10', and an annular outer surface formed with an annular engaging groove 221. When the second electrical terminal 22 is inserted into the female coupling head 21, the engaging arm 211 of the female coupling head 21 engages the annular engaging groove 221, thereby positioning the second electrical terminal 22 in the female coupling head 21. Thereafter, an insertion end portion of the male coupling head 11 is inserted into the female coupling head 21. Hence, the first electrical terminal 12 is coupled electrically to the second electrical terminal 22.

In such a configuration, when separating the first electrical terminal 12 from the male coupling head 11, the positioning member 13 is removed from the male coupling head 11, and thereafter the engaging arm 111 of the male coupling head 11 is disengaged from the engaging groove 121 in the first electrical terminal 12 by means of a tool (not shown). However, it is difficult to separate the second electrical terminal 22 from the female coupling head 21. As a result, the engaging arm 211 of the female coupling head 21 may be damaged if the engaging arm 211 of the female coupling head 21 is disengaged forcedly from the engaging groove 221 in the second electrical terminal 22, thereby resulting in inconvenience during disassembly.

SUMMARY OF THE INVENTION

Therefore, the object of the present invention is to provide an electrical terminal assembly having a detachable coupling head that is can be easily assembled to and disassembled from a terminal.

According to one aspect of the present invention, an electrical terminal assembly comprises:

a coupling head including a sleeve body having opposite first and second open ends, and an annular inner surface, and a plurality of resilient engaging arms that are arranged circumferentially in the sleeve body, each of the resilient engaging arms having a fixed end connected integrally to the annular inner surface of the sleeve body, and a free end opposite to the fixed end, extending toward the first open end of the sleeve body and spaced apart from the annular inner surface of the sleeve body, each of the engaging arms being formed with a radially and inwardly extending engaging protrusion; and a tubular electrical terminal extending into the sleeve body via the second open end and having an annular outer surface, the annular outer surface being formed with an annular engaging groove engaging detachably the engaging protrusions of the engaging arms of the coupling head, thereby confining the electrical terminal in the sleeve body.

The engaging arms of the coupling head are operable so as to move the free ends of the engaging arms toward the inner surface of the sleeve body such that the engaging protrusions of the engaging arms are disengaged from the annular engaging groove in the annular outer surface of the electrical terminal, thereby permitting separation of the electrical terminal from the coupling head.

According to another aspect of the present invention, there is provided a coupling head adapted to be coupled with a tubular electrical terminal. The electrical terminal has an annular outer surface formed with an annular engaging groove. The coupling head comprises:

a sleeve body having opposite first and second open ends, and an annular inner surface and adapted for permitting insertion of the electrical terminal thereinto via the second open end; and a plurality of resilient engaging arms that are arranged circumferentially in the sleeve body, each of the resilient engaging arms having a fixed end connected integrally to the annular inner surface of the sleeve body, and a free end opposite to the fixed end, extending toward the first open end of the sleeve body and spaced apart from the annular inner surface of the sleeve body, each of the engaging arms being formed with a radially and inwardly extending engaging protrusion.

When the electrical terminal is inserted into the sleeve body, the engaging protrusions of the engaging arms are adapted to engage detachably the annular engaging groove in the annular outer surface of the electrical terminal, thereby confining the electrical terminal in the sleeve body.

According to yet another aspect of the present invention, an electrical terminal assembly comprises:

a coupling head including a sleeve body having opposite first and second open ends, and an annular inner surface, and a plurality of resilient engaging arms that are arranged circumferentially in the sleeve body, each of the resilient engaging arms having a fixed end connected integrally to the annular inner surface of the sleeve body, and a free end opposite to the fixed end, extending toward the first open end of the sleeve body and spaced apart from the annular inner surface of the sleeve body, each of the engaging arms being formed with a radially and inwardly extending engaging protrusion;

a tubular electrical terminal extending into the sleeve body via the second open end and having an annular outer surface, the annular outer surface being formed with an annular engaging groove engaging detachably the engaging protrusions of the engaging arms of the coupling head, thereby confining the electrical terminal in the sleeve body; and a tubular tool having an actuating end portion that has an annular inclined outer surface, the tool being operable so as to be inserted into the sleeve body via the first open end such that the actuating end portion is disposed between the annular outer surface of the electrical terminal and the free ends of the engaging arms of the coupling head so as to move the free ends of the engaging arms toward the inner surface of the sleeve body, thereby disengaging the engaging protrusions of the engaging arms from the annular engaging groove in the annular outer surface of the electrical terminal.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
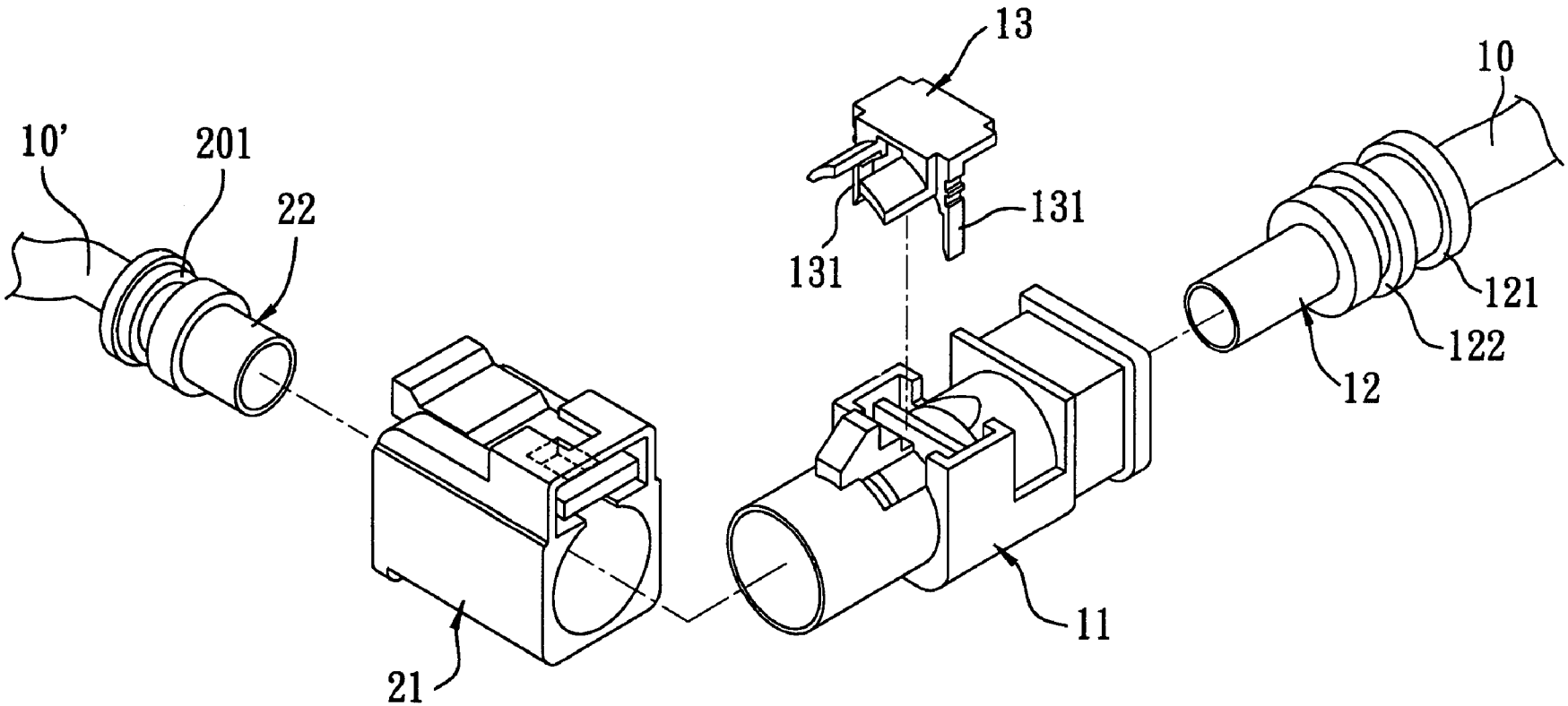
FIG. 1 PRIOR ART
FIG. 1 is an exploded perspective view of a conventional electrical terminal assembly.
Figure 2:
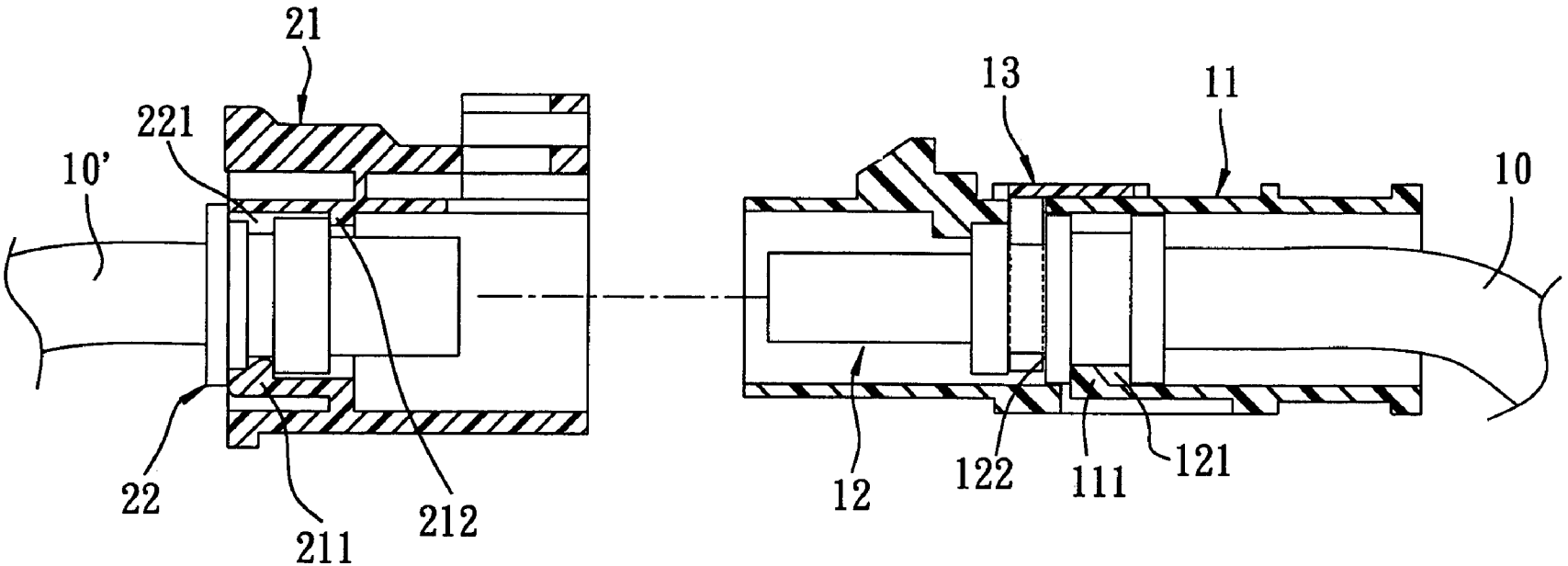
FIG. 2 PRIOR ART
FIG. 2 is a partly exploded, schematic sectional view of the conventional electrical terminal assembly.

Before the present invention is described in greater detail, it should be noted that like elements are denoted by the same reference numerals throughout the disclosure.

Referring to FIGS. 3 to 6, the first preferred embodiment of an electrical terminal assembly according to the present invention is shown to be adapted for interconnecting first and second transmission wires 201, 201', and includes a first coupling head 3, a tubular first electrical terminal 4, a second coupling head 5, a tubular second electrical terminal 6, and a tubular tool 7.

Figure 4:
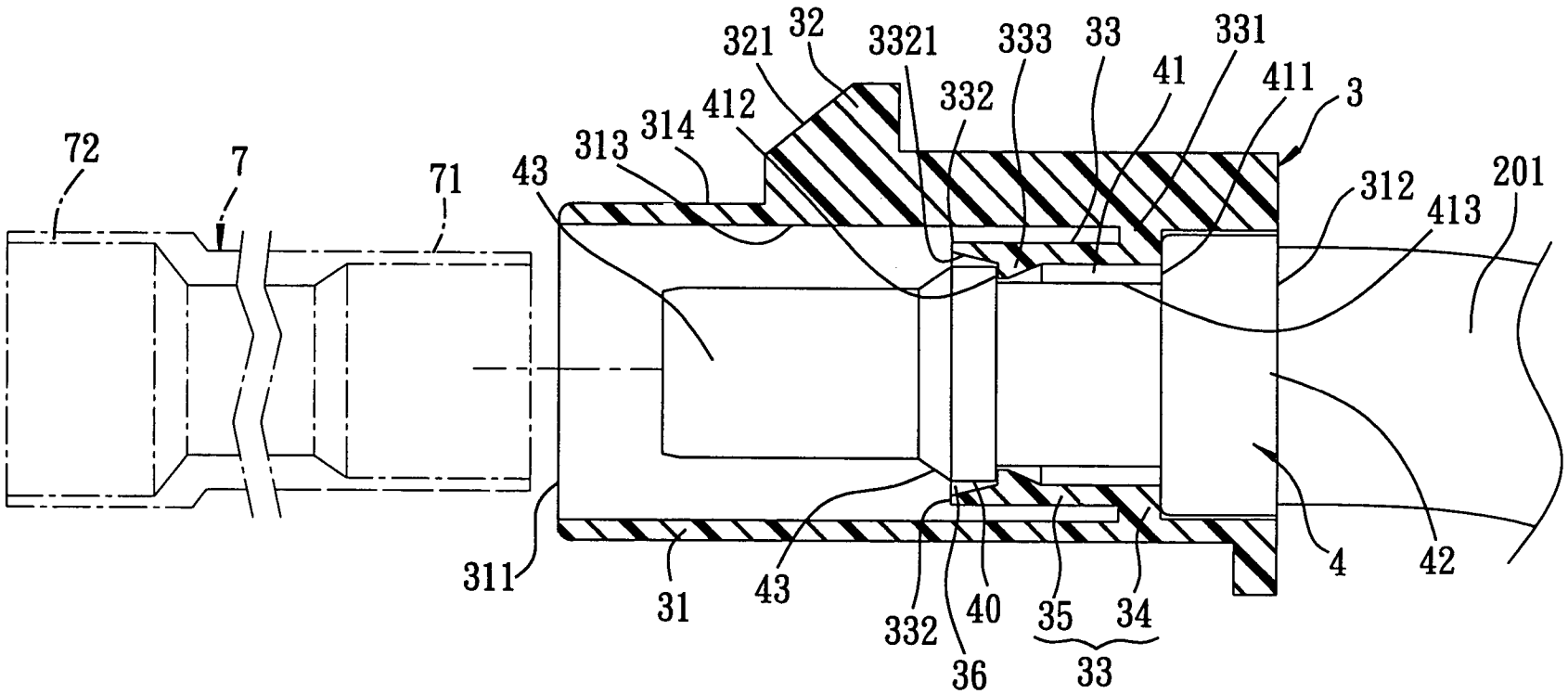
FIG. 4 is a schematic sectional view showing an assembly of a first coupling head and a first electrical terminal of the first preferred embodiment.

As shown in FIG. 4, in this embodiment, the first coupling head 3 is made of plastic, and is configured as a male coupling head. The first coupling head 3 includes a sleeve body 31 and a plurality of resilient engaging arms 33. The sleeve body 31 has opposite first and second open ends 311, 312, an annular inner surface 313 and an annular outer surface 314. The annular outer surface 314 is formed with an anchoring block 32 that has an inclined guiding face 321. The engaging arms 33 are arranged circumferentially in the sleeve body 31. Each engaging arm 33 has a fixed end 331 connected integrally to the annular inner surface 313 of the sleeve body 31, and a free end 332 opposite to the fixed end 331, extending toward the first open end 311 of the sleeve body 31 and spaced apart from the annular inner surface 313 of the sleeve body 31. Each engaging arm 33 is formed with a radially and inwardly extending engaging protrusion 333. In this embodiment, each engaging arm 333 has a first arm portion 34 extending radially from the annular inner surface 313 of the sleeve body 31 and configured with the fixed end 331, and a second arm portion 35 configured with the free end 332 and having a connecting end that is opposite to the free end 332 and that is connected to one end of the first arm portion 34. The second arm portion 35 of each engaging arm 33 is further configured with the engaging protrusion 333. Furthermore, each engaging arm 33 has an inclined abutting surface 3321 that extends inwardly and rearwardly from the free end 332.

Figure 3:
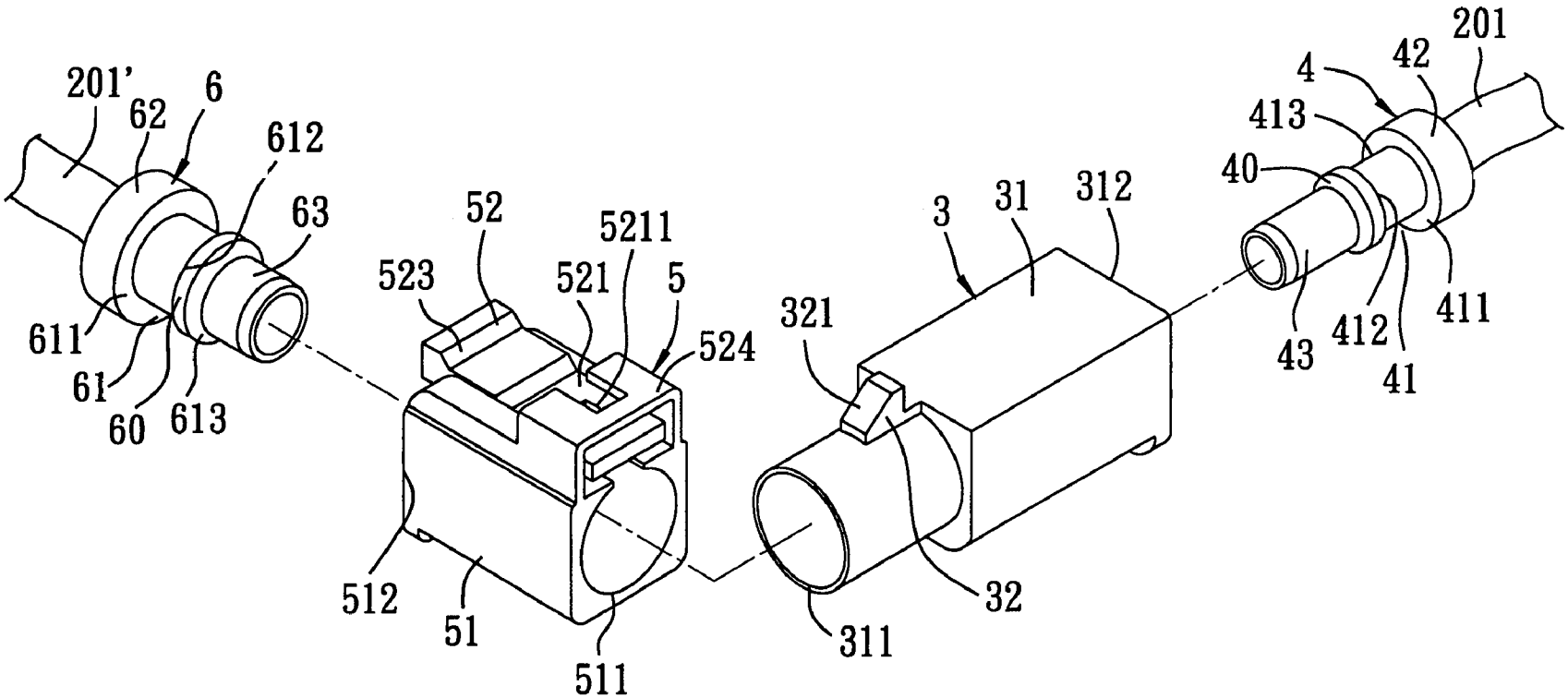
FIG. 3 is an exploded perspective view showing the first preferred embodiment of an electrical terminal assembly according to the present invention.

As shown in FIGS. 3 and 4, the first electrical terminal 4 is configured as a male terminal, and has a coupling end portion 42 adapted to be electrically coupled to the transmission wire 201, and an insertion end portion 43 opposite to the coupling end portion 42. The first electrical terminal 4 extends into the sleeve body 31 via the second open end 312, and further has an annular outer surface 40 that is formed with an annular engaging groove 41 engaging detachably the engaging protrusions 333 of the engaging arms 33 of the first coupling head 3, thereby confining the first electrical terminal 4 in the sleeve body 31. In this embodiment, the annular engaging groove 41 in the annular outer surface 40 of the first electrical terminal 4 is defined by an annular groove bottom wall 413, and opposite annular first and second lateral walls 411, 412 that abut respectively against the engaging protrusion 333 and the first arm portion 34 of each engaging arm 33 of the first coupling head 3 when the first electrical terminal 4 is inserted into the sleeve body 31 of the first coupling head 3. In this embodiment, the inclined abutting surfaces 3321 of the engaging arms 33 of the first coupling head 3 cooperate with the outer surface 40 of the first electrical terminal 4 to define a tool-inserting space 36.

Figure 5:
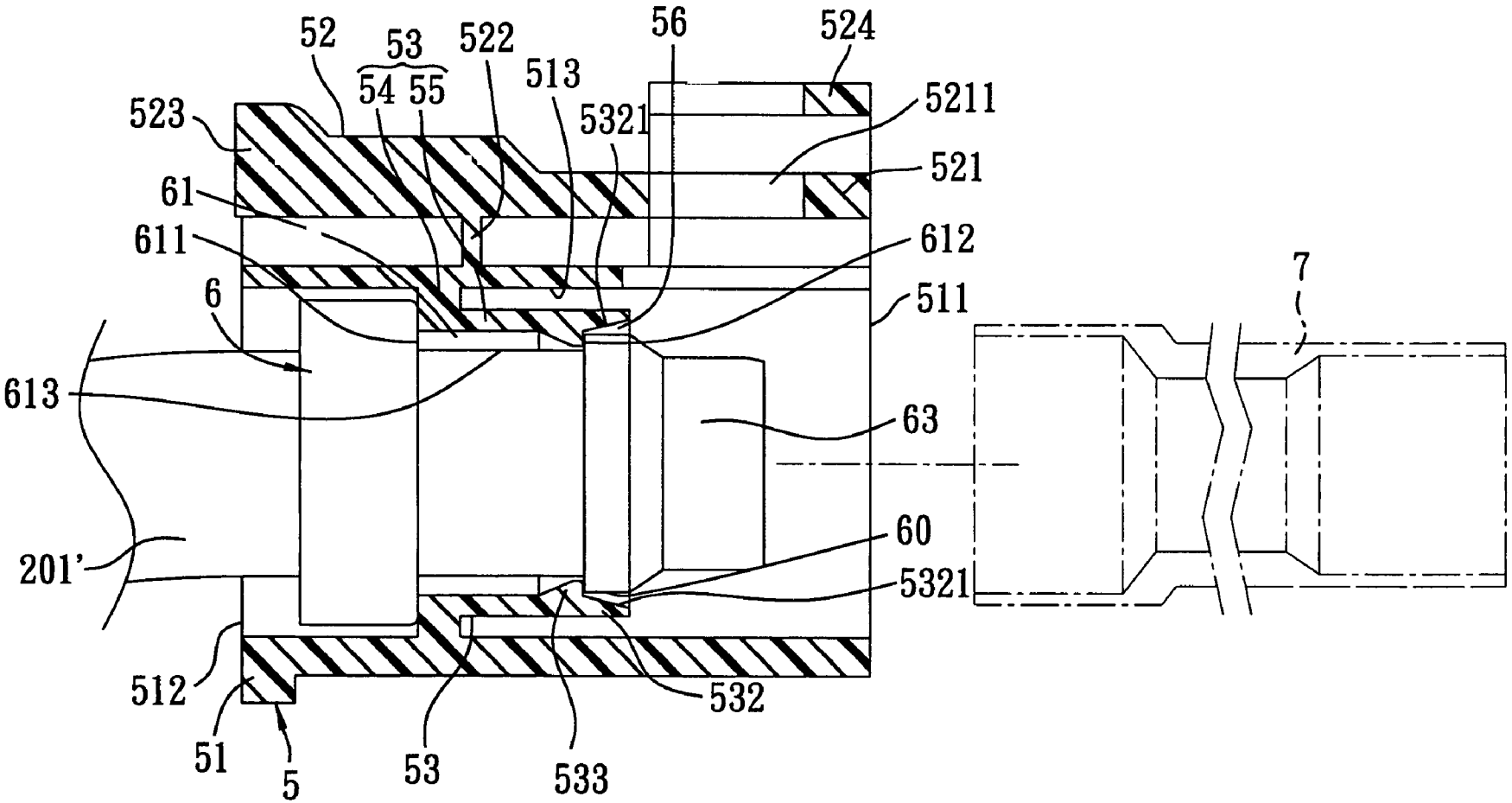
FIG. 5 is a schematic sectional view showing an assembly of a second coupling head and a second electrical terminal of the first preferred embodiment.
Figure 6:
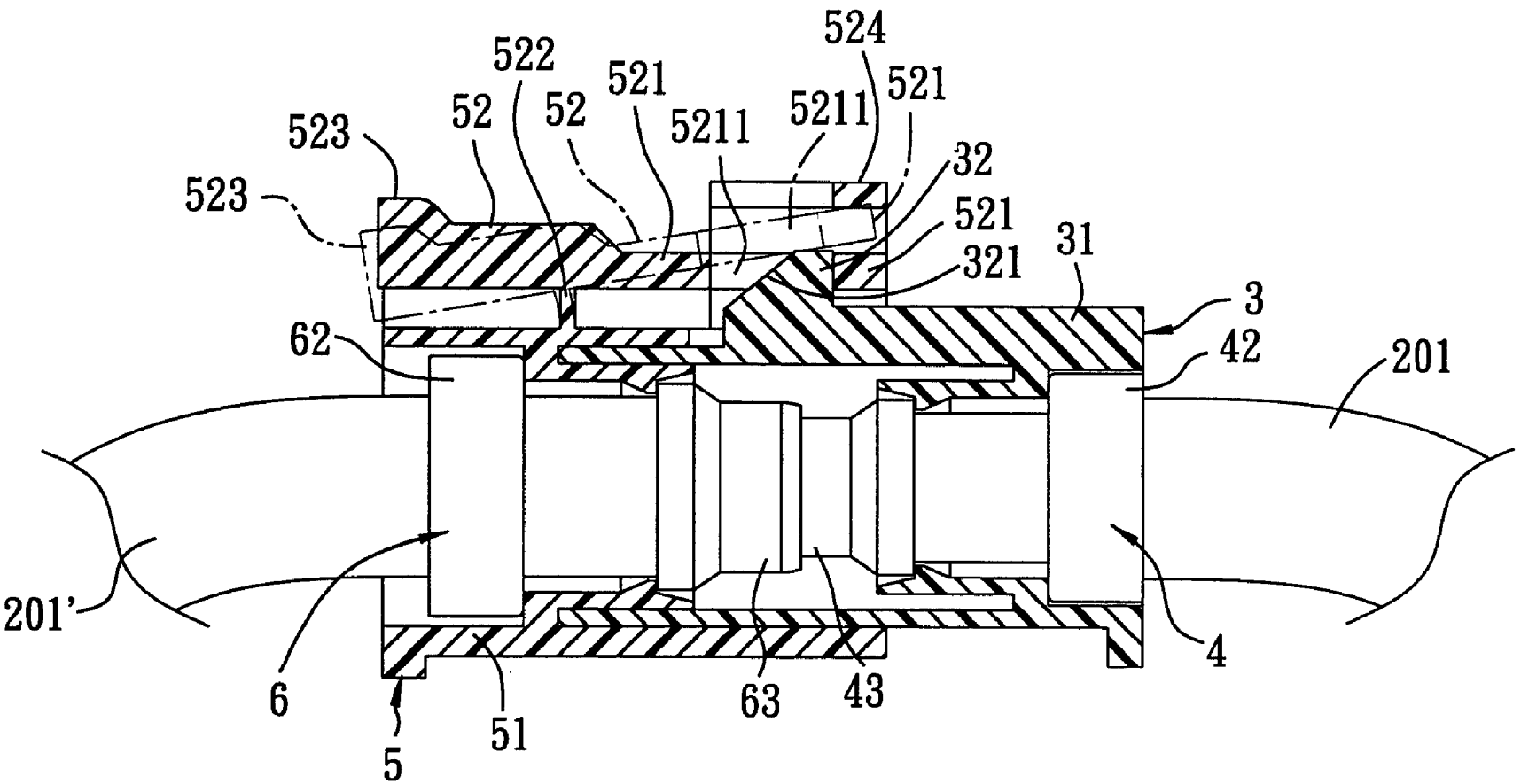
FIG. 6 is a schematic sectional view showing the first preferred embodiment.

As shown in FIGS. 3, 4 and 5, the second coupling head 5 is configured as a female coupling head, and includes a sleeve body 51 and a plurality of resilient engaging arms 53. The sleeve body 51, similar to the sleeve body 31 of the first coupling head 3, has opposite first and second open ends 511, 512, and an annular inner surface 513. The sleeve body 51 permits insertion of an end portion of the first coupling head 3 that has the second open end 311 thereinto via the first open end 511. The engaging arms 53 have the same construction as that of the engaging arms 33 of the first coupling head 3. In this embodiment, the second coupling head 5 differs from the first coupling head 3 in that the second coupling head 5 further includes a mounting seat 524 mounted fixedly on an outer surface of the sleeve body 51 and disposed adjacent to the first open end 511, and an anchoring plate 52 having an operating end portion 523 that is disposed movably above the top surface of the sleeve body 51, an anchoring end portion 521 that is opposite to the operating end portion 523, that is formed with an engaging hole 5211 and that is disposed movably in the mounting seat 524, and an intermediate portion 522 that interconnects the operating end portion 523 and the anchoring end portion 521, that is connected to the top surface of the sleeve body 51 and that serves as a fulcrum. Referring to FIG. 6, when the first coupling head 3 is inserted into sleeve body 51 of the second coupling head 5 via the first open end 511, the anchoring end portion 521 of the anchoring plate 52 moves upwardly relative to the intermediate portion 522 along the guiding face 321 of the anchoring block 32 such that the anchoring block 32 engages the engaging hole 5211 in the anchoring end portion 521 of the anchoring plate 52, thereby anchoring the first coupling head 3 to the second coupling head 5. On the other hand, when the operating end portion 523 of the anchoring plate 52 is depressed, the anchoring end portion 521 of the anchoring plate 52 is thus moved upwardly away from the anchoring block 32, thereby allowing the first coupling head 3 to be separated from the second coupling head 5.

As shown in FIGS. 3 and 5, in this embodiment, the second electrical terminal 6 is configured as a female terminal, and has a coupling end portion 62 adapted to be electrically coupled to the transmission wire 201', and a sleeve end portion 63 opposite to the coupling end portion 62. The second electrical terminal 6 extends into the sleeve body 51 via the second open end 512, and further has an annular outer surface 60 that is formed with an annular engaging groove 61 engaging detachably the engaging protrusions 533 of the engaging arms 53 of the second coupling head 5, thereby confining the second electrical terminal 6 in the sleeve body 51. In this embodiment, the annular engaging groove 61 in the annular outer surface 60 of the second electrical terminal 6 has the same configuration as that of the first electrical terminal 4. Furthermore, the sleeve end portion 63 of the second electrical terminal 6 is sleeved on and is electrically connected to the insertion end portion 43 of the first electrical terminal 4, as shown in FIG. 6. Similar to a relation between the first coupling head 3 and the first electrical terminal 4, inclined abutting surfaces 5321 of the engaging arms 53 of the second coupling head 5 cooperate with the outer surface 60 of the second electrical terminal 6 to define a tool-inserting space 56.

Figure 4A:
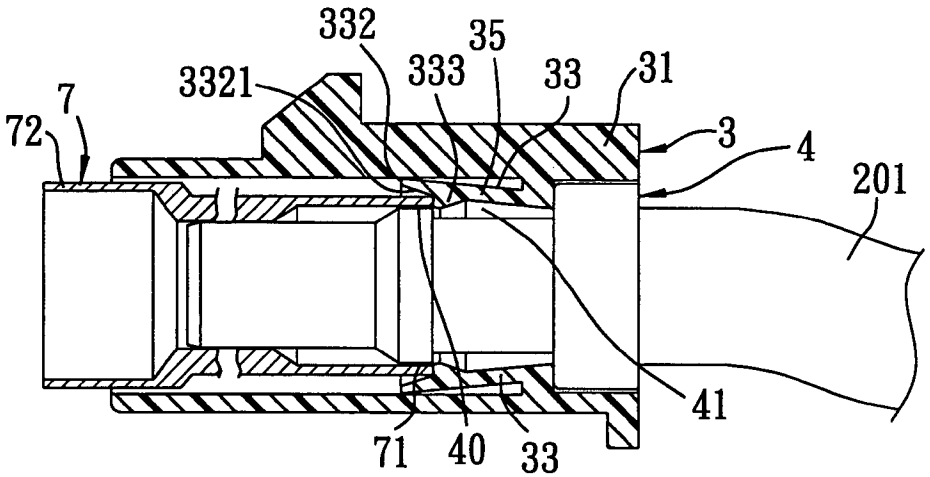
FIGS. 4*a* and 4*b* are schematic sectional views to illustrate how the first electrical terminal is separated from the first coupling head by means of a tool according to the first preferred embodiment.
Figure 4B:
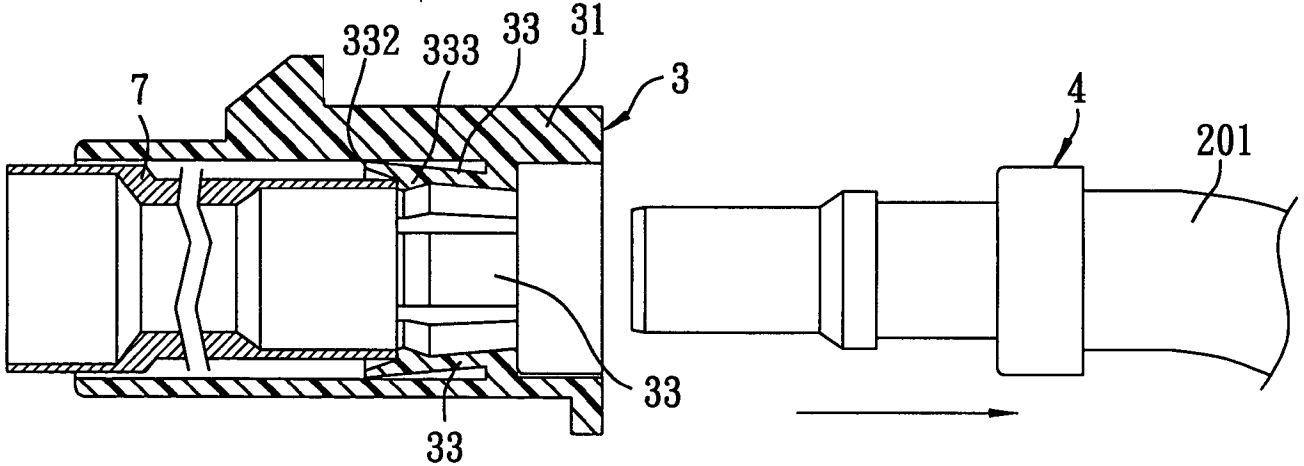

The tool 7 is used to separate respectively the first and second electrical terminals 4, 6 from the first and second coupling heads 3, 5 during disassembly. In this embodiment, the tool 7 has opposite first and second actuating end portions 71, 72, as shown in FIG. 4. The first actuating end portion 71 of the tool 7 is operable so as to be inserted into the sleeve body 31 of the first coupling head 3, i.e., the tool-inserting space 36, via the front open end 311 such that the first actuating end portion 71 is disposed between the annular outer surface 40 of the first electrical terminal 4 and the free ends 332 of the engaging arms 33 of the first coupling head 3 so as to move the free ends 332 of the engaging arms 33 toward the inner surface 313 of the sleeve body 31 of the first coupling head 3, thereby disengaging the engaging protrusions 333 of the engaging arms 33 of the first coupling head 3 from the annular engaging groove 41 in the annular outer surface 40 of the first electrical terminal 4, as shown in FIG. 4*a*. Thereafter, the first electrical terminal 4 can be easily separated from the first coupling head 3, as shown in FIG. 4*b*. Similarly, the second electrical terminal 6 can be separated from the second coupling head 5 by insertion of the second actuating end portion 72 of the tool 7 into the tool-inserting space 56 in an assembly of the second coupling head 5 and the second electrical terminal 6.

Figure 7:
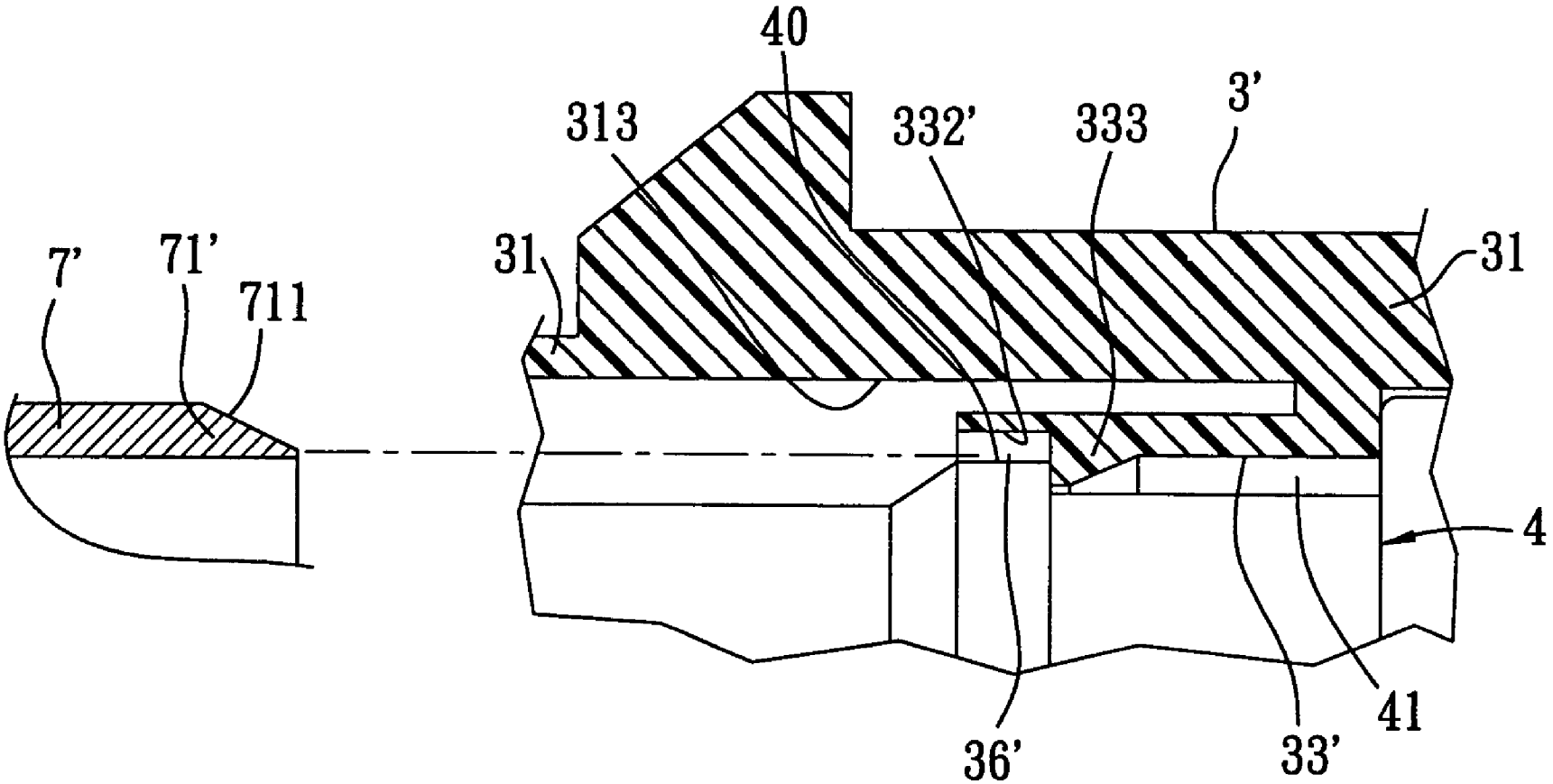
FIG. 7 is a fragmentary schematic sectional view showing the second preferred embodiment of an electrical terminal assembly according to the present invention.

FIG. 7 illustrates the second preferred embodiment of an electrical terminal assembly according to this invention, which is a modification of the first preferred embodiment. In this embodiment, each engaging arm 33' does not have the inclined abutting surface 3321 of the first preferred embodiment, but the first actuating end portion 71' of the tool 7' has an annular inclined outer surface 711. Therefore, when the first actuating end portion 71' of the tool 7' is inserted into the tool-inserting space 36' in an assembly of the first coupling head 3' and the first electrical terminal 4, due to the presence of the inclined outer surface 711, the free ends 332' of the engaging arms 33' of the first coupling head 3' are moved toward the inner surface 313 of the sleeve body 31 of the first coupling head 3', thereby disengaging the engaging protrusions 333 of the engaging arms 33' from the annular engaging groove 41 in the annular outer surface 40 of the first electrical terminal 4.

In sum, due to the engagement between the engaging arms 33, 33', 53 of the first and second coupling heads 3, 3', 5, and the annular engaging grooves 41, 61 in the first and second electrical terminals 4, 6, the first and second electrical terminals 4, 6 can be easily and respectively assembled to the first and second coupling heads 3, 3', 5. Furthermore, by using the tool 7, 7', the first and second electrical terminals 4, 6 can be easily and respectively separated from the first and second coupling heads 3, 3', 5.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical terminal assembly comprising:

a coupling head including a sleeve body having opposite first and second open ends, and an annular inner surface, and a plurality of resilient engaging arms that are arranged circumferentially in said sleeve body, each of said resilient engaging arms having a fixed end connected integrally to said annular inner surface of said sleeve body, and a free end opposite to said fixed end, extending toward said first open end of said sleeve body and spaced apart from said annular inner surface of said sleeve body, each of said engaging arms being formed with a radially and inwardly extending engaging protrusion; and a tubular electrical terminal extending into said sleeve body via said second open end and having an annular outer surface, said annular outer surface being formed with an annular engaging groove engaging detachably said engaging protrusions of said engaging arms of said coupling head, thereby confining said electrical terminal in said sleeve body;

said engaging arms of said coupling head being operable so as to move said free ends of said engaging arms toward said inner surface of said sleeve body such that said engaging protrusions of said engaging arms are disengaged from said annular engaging groove in said annular outer surface of said electrical terminal, thereby permitting separation of said electrical terminal from said coupling head.

2. The electrical terminal assembly as claimed in claim 1, wherein each of said engaging arms has an inclined abutting surface that extends inwardly and rearwardly from said free end, said inclined abutting surfaces of said engaging arms cooperating with said outer surface of said electrical terminal to define a tool-inserting space adapted for permitting insertion of a tool thereinto so as to move said free ends of said engaging arms toward said inner surface of said sleeve body of said coupling head.

3. The electrical terminal assembly as claimed in claim 1, wherein:

each of said engaging arms of said coupling head has a first arm portion extending radially from said annular inner surface of said sleeve body and configured with said fixed end, and a second arm portion configured with said free end and having a connecting end that is opposite to said free end and that is connected to one end of said first arm portion, said second arm portion of each of said engaging arms being configured with said engaging protrusion; and said annular engaging groove in said annular outer surface of said electrical terminal is defined by an annular groove bottom wall, and opposite annular first and second lateral walls that abut respectively against said engaging protrusion and said first arm portion of each of said engaging arms of said coupling head when said electrical terminal is inserted into said sleeve body of said coupling head.

4. A coupling head adapted to be coupled with a tubular electrical terminal, the electrical terminal having an annular outer surface formed with an annular engaging groove, said coupling head comprising:

a sleeve body having opposite first and second open ends, and an annular inner surface and adapted for permitting insertion of the electrical terminal thereinto via said second open end; and a plurality of resilient engaging arms that are arranged circumferentially in said sleeve body, each of said resilient engaging arms having a fixed end connected integrally to said annular inner surface of said sleeve body, and a free end opposite to said fixed end, extending toward said first open end of said sleeve body and spaced apart from said annular inner surface of said sleeve body, each of said engaging arms being formed with a radially and inwardly extending engaging protrusion;

wherein, when the electrical terminal is inserted into said sleeve body, said engaging protrusions of said engaging arms are adapted to engage detachably the annular engaging groove in the annular outer surface of the electrical terminal, thereby confining the electrical terminal in said sleeve body.

5. The coupling head as claimed in claim 4, wherein each of said engaging arms has an inclined abutting surface that extends inwardly and rearwardly from said free end, said inclined abutting surfaces of said engaging arms being adapted to cooperate with the annular outer surface of the electrical terminal to define a tool-inserting space adapted for permitting insertion of a tool thereinto so as to move said free ends of said engaging arms toward said inner surface of said sleeve body of said coupling head, thereby disengaging said engaging protrusions from said engaging groove.

6. The coupling head as claimed in claim 4, wherein each of said engaging arms of said coupling head has a first arm portion extending radially from said annular inner surface of said sleeve body and configured with said fixed end, and a second arm portion configured with said free end and having a connecting end that is opposite to said free end and that is connected to one end of said first arm portion, said second arm portion of each of said engaging arms being configured with said engaging protrusion.

7. An electrical terminal assembly comprising:

a coupling head including a sleeve body having opposite first and second open ends, and an annular inner surface, and a plurality of resilient engaging arms that are arranged circumferentially in said sleeve body, each of said resilient engaging arms having a fixed end connected integrally to said annular inner surface of said sleeve body, and a free end opposite to said fixed end, extending toward said first open end of said sleeve body and spaced apart from said annular inner surface of said sleeve body, each of said engaging arms being formed with a radially and inwardly extending engaging protrusion;

a tubular electrical terminal extending into said sleeve body via said second open end and having an annular outer surface, said annular outer surface being formed with an annular engaging groove engaging detachably said engaging protrusions of said engaging arms of said coupling head, thereby confining said electrical terminal in said sleeve body; and a tubular tool having an actuating end portion that has an annular inclined outer surface, said tool being operable so as to be inserted into said sleeve body via said first open end such that said actuating end portion is disposed between said annular outer surface of said electrical terminal and said free ends of said engaging arms of said coupling head so as to move said free ends of said engaging arms toward said inner surface of said sleeve body, thereby disengaging said engaging protrusions of said engaging arms from said annular engaging groove in said annular outer surface of said electrical terminal.

* * * * *